US006425196B1

(12) United States Patent
Weagley et al.

(10) Patent No.: US 6,425,196 B1
(45) Date of Patent: Jul. 30, 2002

(54) FOLDING PUSHER

(75) Inventors: Michael P. Weagley, Rush; Michael J. Guggino, Bloomfield; John W. Singer, Macedon, all of NY (US)

(73) Assignee: Pro-Tech Welding and Fabrication, Inc., Rochester, NY (US)

( * ) Notice: Subject to any disclaimer, the term of this patent is extended or adjusted under 35 U.S.C. 154(b) by 0 days.

(21) Appl. No.: 09/634,141

(22) Filed: Aug. 8, 2000

(51) Int. Cl.[7] ..... E01H 5/06; E02F 3/76

(52) U.S. Cl. ..... 37/270; 37/281; 172/393; 172/815; 172/832

(58) Field of Search ..... 37/266, 270, 273, 37/274, 281; 172/298, 387, 393, 684.5, 701, 815, 832

(56) References Cited

U.S. PATENT DOCUMENTS

| | | | | |
|---|---|---|---|---|
| 1,373,799 A | | 4/1921 | Conley | |
| 1,581,414 A | | 4/1926 | Young | |
| 2,078,636 A | | 4/1937 | Kuchar | |
| 4,019,268 A | | 4/1977 | Waterman | |
| 4,275,514 A | | 6/1981 | Maura | |
| 4,306,362 A | | 12/1981 | Waterman | |
| 4,356,645 A | | 11/1982 | Hine | |
| 4,707,936 A | * | 11/1987 | Steinhoff | 37/264 |
| 4,723,609 A | | 2/1988 | Curtis | |
| 4,779,363 A | | 10/1988 | Boutrais | |
| 5,638,618 A | | 6/1997 | Niemela | |
| 5,655,318 A | | 8/1997 | Daniels | |
| 5,724,755 A | * | 3/1998 | Weagley | 37/233 |
| 5,819,444 A | | 10/1998 | Desmarais | |
| 6,112,438 A | | 9/2000 | Weagley | |
| 6,298,585 B1 | * | 10/2001 | Boulet | 37/903 |

* cited by examiner

*Primary Examiner*—Gary S. Hartmann
(74) *Attorney, Agent, or Firm*—Greenwald & Basch LLP; Duane C. Basch

(57) ABSTRACT

The present invention is an apparatus for use on large areas such as parking lots and airport runways to remove snow and other debris or material therefrom. The apparatus includes at least two blades pivotally connected to one another, and mounting receptacle or bracket having a series of pairs of posts extending from the rear thereof to facilitate operational attachment to a loader or similar construction equipment. The present invention further includes improvements to enable the segmenting and automatic folding of the pusher.

14 Claims, 6 Drawing Sheets

FOLDING PUSHER

CROSS REFERENCE

The following related application is hereby incorporated by reference for its teachings:

"SNOW PLOW" Michael P. Weagley, application Ser. No. 09/134,765, filed Aug. 14, 1998, now U.S. Pat. No. 6,112,438.

This invention relates generally to an apparatus for use on large areas such as parking lots and airport runways to remove snow and other debris therefrom, and more particularly to improvements to allow for the segmenting and automatic folding of a pusher, and to aspects resulting in reduced cost of manufacturing.

BACKGROUND AND SUMMARY OF THE INVENTION

The present invention is an improved, folding plow for use on large, generally flat areas such as parking lots and airport runways, referred to herein as a "pusher."

A "pusher" is generally wider than a snow plow used on streets and roads, and includes sides extending forward from the mold board to assure material being pushed (e.g., snow, water, debris, sludge, etc.) remains in front of the pusher, and is not pushed to the side as is done by conventional plows. Preferably mounted on the bucket of, or otherwise attached to, a front end or wheel loader (its ordinary operating position), most pushers cannot be safely transported from one site to another while attached to the loader. In order to use such a plow at more than one site, it must be transported from place to place on an equipment trailer or flatbed truck.

Heretofore, a number of patents and publications have disclosed plows, the relevant portions of which may be briefly summarized as follows:

U.S. Pat. No. 4,019,268 to Waterman, issued Apr. 26, 1977, teaches an apparatus for grooming snow that is attachable to flat bed vehicles provided with hydraulic power. The center section of the snow compactor is pivotally secured to the vehicle. The ends of the outermost plow sections (wings 21) are capable of being rotated upwardly by hydraulic means for transportation.

U.S. Pat. No. 4,723,609 to Curtis, issued Feb. 9, 1988, discloses a scraper with a medial blade member and pivotally connected later wing blade members (28). When desired to scrape material, the wing members are angled in the direction toward the mass to be accumulated. The wing members are moved to a desired angle by manipulation of hydraulic control valve associated with hydraulic cylinders that move the wings.

U.S. Pat. No. 4,779,363 to Boutrais et al., issued Oct. 25, 1988, teaches an apparatus for use on a pusher vehicle to clear, collect and transport objects lying on the ground. Pivoting side walls (3) are opened and closed relative to the rear wall by a hydraulic mechanism.

U.S. Pat. No. 5,638,618 to Niemela et al., issued Jun. 17, 1997, is directed to an adjustable wing plow for moving snow and other materials. As depicted in FIG. 25, a hydraulic system is employed to control the configuration of the plow, and adjustable wings, at any time.

U.S. Pat. No. 5,655,318 Daniels, issued Aug. 12, 1997, discloses a pusher blade with pivotable end extensions. The pivotally connected blades may be stored in a blade storage position along the back side of the adjoining main or central blade.

U.S. Pat. No. 5,724,755, issued to Michael P. Weagley on Mar. 10, 1998 and hereby incorporated by reference in its entirety, teaches a pusher including a blade with horizontal and vertical reinforcing channels, a reversible rubber edge fastened to the blade and extending below its bottom edge, and a side plate extending forward from each end of the blade. Side plates each include a removable wear shoe with inclined ramps for sliding contact on the ground surface. Upper and lower rows of posts extend rearward from the blade to form a slot for insertion of a front end loader bucket.

U.S. Pat. No. 5,819,444 to Desmarais, issued Oct. 13, 1998, discloses a snow blade with tiltable lateral wing blade that is hinged so as to take an inclination forward or rearward of the main blade.

In accordance with the present invention, there is provided a foldable apparatus for pushing material, including: an upstanding central blade; means for attaching the pushing apparatus to a vehicle used for moving the pushing apparatus; left and right end blades; left and right hinges for pivotally connecting the respective left and right end blades with the corresponding ends of said central blade for movement relative to said central blade between open positions substantially in line with said central blade, and folded positions forward of and substantially normal to said central blade; a rubber edge removably fastened to each of said central, left end and right end blades and extending along and below the bottom edge thereof; a vertical side wall extending forward at a right angle from the outer end of each of said end blades, said side walls each including a removable longitudinal runner along the bottom of said wall, said runners having inclined front and rear ramp surfaces for sliding contact on a ground surface, said runners effective to provide clearance space under the bottom edges of said blades; and locking means to lock said end blades in said open positions and in said folded positions.

In accordance with another aspect of the present invention, there is provided a material pushing apparatus, including: an upstanding left blade; an upstanding right blade; a mounting bracket for pivotally interconnecting the left and right blades, said mounting bracket including an upper row of posts projecting horizontally rearward from said central blade and a lower row of posts projecting horizontally rearward from said central blade so as to form a slot therebetween for removable insertion of a bucket to lift and push said apparatus, said left and right end blades pivotally connected to said mounting bracket for movement relative thereto between an open position wherein the left and right blades are substantially linearly aligned, and a folded position wherein the left and right blades are brought forward of and nearly normal to said mounting bracket; a rubber edge removably fastened to each of said left and right blades and extending along and below the bottom edge thereof; a vertical side wall extending forward at a right angle from the outer end of each of said left and right blades, said side walls each including a wear shoe removably mounted thereon, said wear shoes each including a bottom longitudinal runner with inclined front and rear ramp surfaces for making contact on a ground surface said, runners effective to provide clearance space under the bottom edges of said blades; and locking means to lock said end blades alternatively in said open positions and in said folded positions.

In accordance with yet another aspect of the present invention, there is provided a material pushing apparatus, including: an upstanding first blade; an upstanding second blade; a hinge for pivotally interconnecting the first and second blades for movement relative thereto between an open position wherein the first and second blades are substantially linearly aligned, and a folded position wherein the left and right blades are brought forward of said hinge so as to form an acute angle between the first and second blades; a rubber edge removably fastened to each of said first and second blades and extending along and below the bottom edges thereof; a vertical side wall extending forward at a right angle from the outer end of each of said first and second blades, said side walls each including a wear shoe removably mounted thereon, said wear shoes each including a bottom longitudinal runner with inclined front and rear ramp surfaces for making contact on a ground surface said, runners effective to provide clearance space under the bottom edges of said blades; means, positioned adjacent a rear surface of at least one of said first and second blades, for mounting the apparatus, said mounting means including an upper row of posts projecting horizontally rearward from the rear surface and a lower row of posts projecting horizontally rearward from the rear surface so as to form a slot therebetween for removable insertion of a bucket to lift and push said apparatus and locking means to lock said first and second blades alternatively in the open position and in said folded position.

One aspect of the invention is based on the observation of problems with conventional snow and debris removal equipment—the inability to easily transport the equipment from one location to another.

This aspect is based on the discovery of a technique that alleviates these problems by providing one or more hinges to allow the pusher to be folded for transportation, but to retain its rigidity in an open or operating condition.

This technique can be implemented, for example, by a central hinge or a pair of hinges for each of two side blades. A machine implementing the invention can include a pusher or similar device suitable for pushing material along a generally flat surface. The techniques described herein are advantageous because it is simple and inexpensive compared to other approaches. Moreover, the techniques described improve the functionality of the pusher, making it unnecessary to have a plurality of pushers located at nearby locations. The techniques of the invention are advantageous because they provide a range of alternative embodiments, each of which is useful in appropriate situations.

Figure 1:
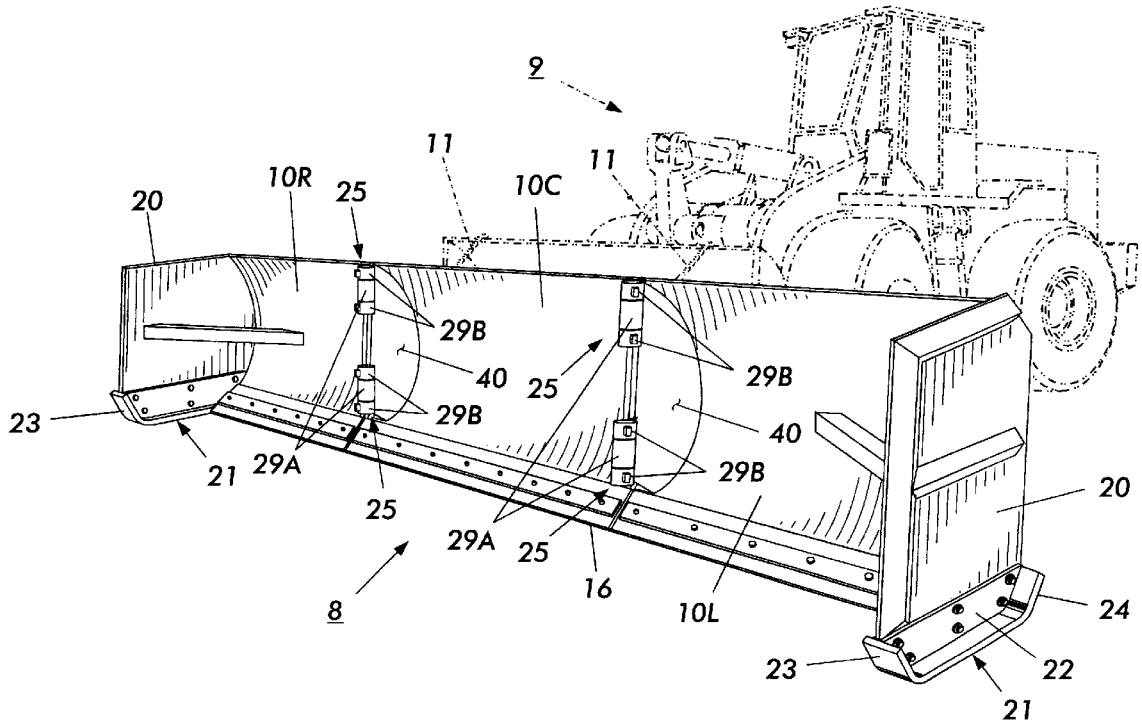
FIG. 1 is a perspective illustration of a pusher attached to a front end loader in accordance with an embodiment of the present invention.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by the appended claims.

DESCRIPTION OF THE PREFERRED EMBODIMENT

For a general understanding of the present invention, reference is made to the drawings. In the drawings, like reference numerals have been used throughout to designate identical elements.

In this description, "ground surface" is intended as a convenient term to include any surface such as roadway, parking lot, runway, or the like where this pusher is to be used to move material or debris (including snow, liquids, sludge, refuse, etc.). Similarly, "rubber" is intended to include the entire range of rubbers or elastomeric materials suitable for the uses described herein.

Referring to FIG. 1, depicted therein is a pusher 8, including an upstanding central blade 10C, and left and right end blades 10L, 10R pivotally connected to left and right ends respectively of the central blade 10C. Vertical side walls 20 extend forward from the outer ends of the end blades 10L, 10R.

Figure 2:
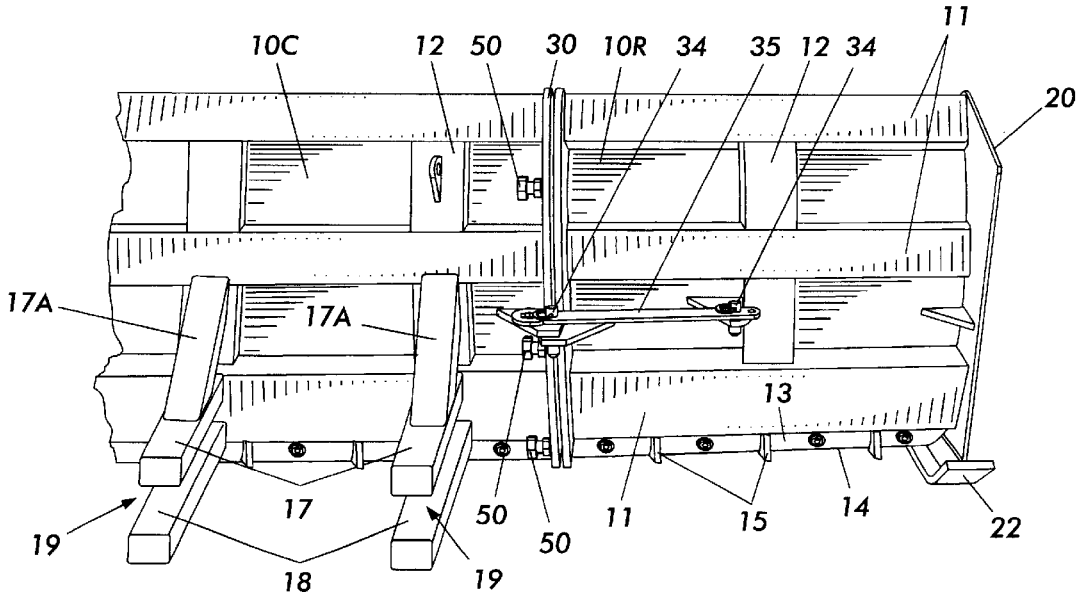
FIG. 2 is a rear view of the pusher of FIG. 1.

Referring briefly to FIG. 2, the back of each of the blades 10C, 10L, 10R includes horizontal bracing channels 11 welded at least substantially across its width, and a backing flat stock member 13 behind and along the length of its bottom edge. Reinforcing gussets 15 are spaced along the backing members 13. The central blade 10C and end blades 10R, 10R further include vertical reinforcing channels 12 welded between its horizontal channels 11.

A resilient rubber edge 16 is removably mounted along the bottoms of the blades 10C, 10L, 10R to extend below their steel edges 14. The rubber edges 16 are adjustable, reversible and replaceable to accommodate for wear.

The center blade 10C (FIGS. 1 and 2) Includes an upper horizontal row of three posts 17, and a lower horizontal row of three posts 18, extending out from the lowermost horizontal channel 11 on the back of the blade. The posts are rectangular in cross section. The two rows of posts 17, 18 form a horizontal slot 19 between them. Upper posts 17 preferably include an angled brace 17A that extends from the upper surface of post 17 to the rear of center blade 10C along the channels 11 and 12, thereby providing a distributed surface of the brace to dissipate the significant load placed on the upper post 17 when the pusher is lifted off the ground.

The bucket of a wheel loader, tractor loader backhoe or similar vehicle fits into the slot 19 to engage the blade 10C. Installation of the plow on (and removal from) the loader bucket is quick and easy. Post 18 may extend rearward from the blade 10C by a distance slightly greater (approximately 1 to 5 inches) than post 17 in order to enable the operator of the vehicle to place the bucket on the lower post 18 and to use the lower post to guide the bucket completely into the slot 19. As illustrated in FIG. 1, a chain and ratchet binder assembly 11 are used to attach the pusher to the bucket or front lifting arms of a loader 9.

The side walls 20 each include a removable wear shoe 21 with a bottom runner 22 for sliding contact with the ground surface. The bottom runners 22 include front and back ramp surfaces (23, 24 respectively) for easy riding over surface irregularities. The wear shoes 21 are preferably "sacrificial" members of the pusher. They are removably mounted to side walls 20 using bolts or equivalent fasteners for replacement when necessary. The wear shoes 21 also provide a clearance between ground level and the steel along the bottom edge 14 of each of the pusher blades (10C, 10L, and 10R). The rubber edge 16 extends below the steel edge 14 to act like a "squeegee" on the ground surface, but does not bear the weight of the apparatus. The rubber edge 16 is flexible enough to glide over many surface irregularities without gouging asphalt, concrete, or tar-gravel. It also rides easily over grates, manhole covers, and other such potential hazards, permitting higher speed and damage-free snow removal.

Figure 3:
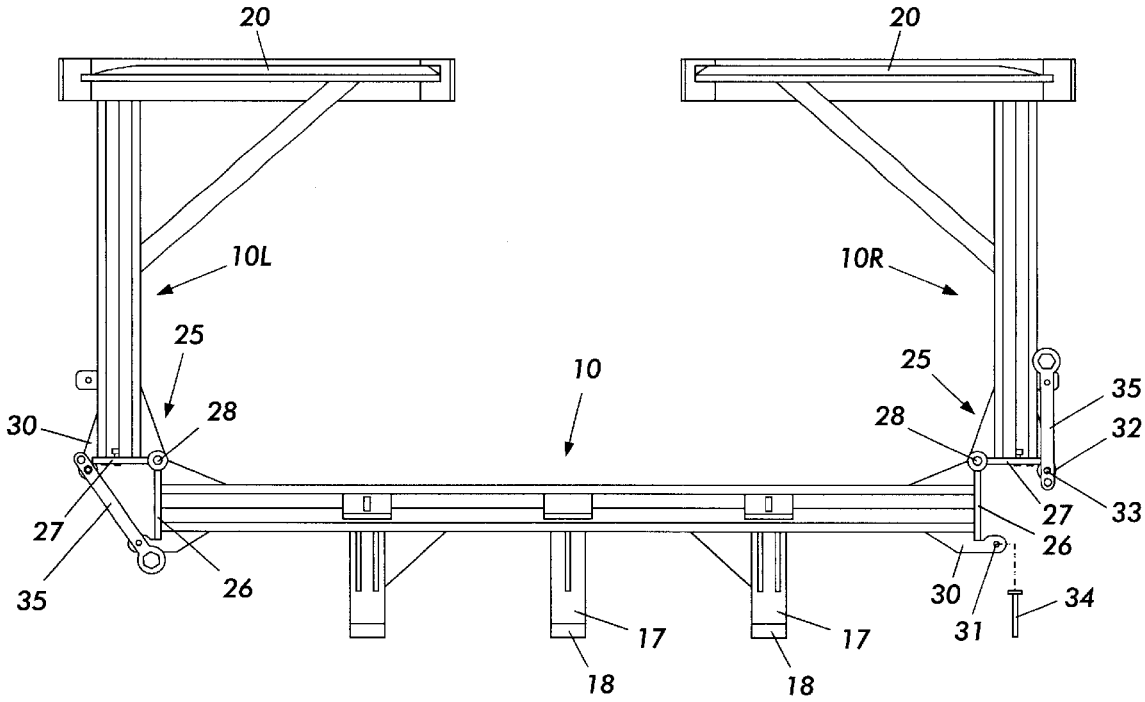
FIG. 3 is a top view of the pusher of FIG. 1 in a folded condition.

Referring to FIG. 3, the left and right end blades 10L, 10R are mounted on the central blade 10C by hinges 25 for pivotal movement between a closed or folded configuration (FIG. 1) and an open or straight configuration (FIG. 3).

The central blade 10C includes a vertical hinge plate 26 at each end. The end blades 10L and 10R each include a vertical hinge plate 27 on its inner end. At the forward edges of each hinge plate are a series of aligned hinge bosses 29A and 29B that are pivotally attached using a hinge pin 28 to complete the hinge connection of end blades 10L, 10R to the central blade 10C. Bosses 29A are central bosses that are preferably on the order of 3–7 inches in height, whereas bosses 29B are positioned above and below the central boss and are preferably on the order of 2–4 inches in height. As a further improvement to assure that hinges 25 remain suitable for opening or folding of the end blades, one or more of the hinge bosses (29A, 29B) include grease fittings to lubricate the bosses and hinge pin 28 passing therethrough. The area about each side of the hinge plate and bosses preferably include a baffle or gusset 40 for reinforcing the hinge plate relative to the blade, and for eliminating the acute-angle corner between the hinge plate and the blade where show or other material may accumulate when being moved by the pusher.

Figure 4:
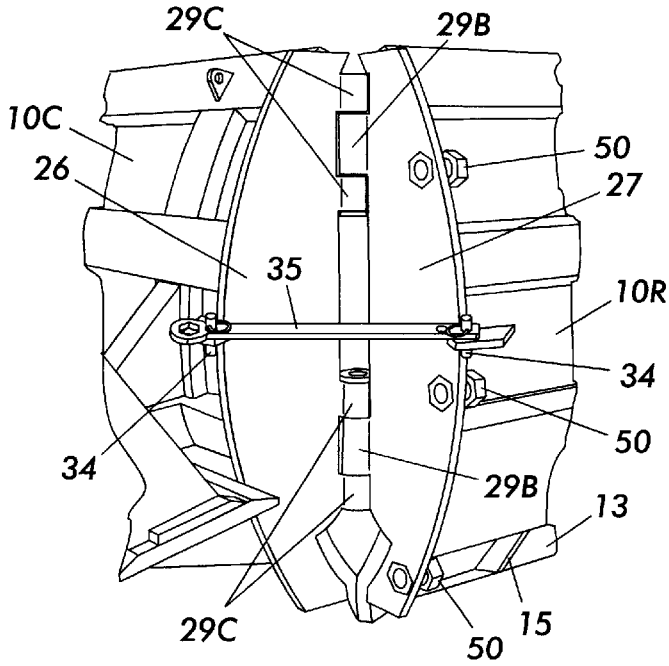
FIG. 4 is as end view of the center and right-most blades of the pusher in a folded configuration.

The hinged connections between blades 10C and 10L, and between blades 10C and 10R, further include means to lock them in their open and closed configurations as depicted in FIGS. 2 and 4. Referring to FIGS. 2 and 4, the central blade 10C includes at each end a lug 30 with a vertical pin hole 31 for a locking pin 34 such as a hitch pin with hairpin used on farm equipment and machinery. In an alternative embodiment the end lug 30 may include an adjustment mechanism wherein the location of the hole for the hitch pin is adjusted in order to assure linear alignment when the center and end blades are in an open configuration.

The end blades 10L, 10R each similarly include at their inner end a lug 32 with a vertical pin hole 33. In the opened or straight configuration of the pusher, shown in FIG. 1, the pin holes 31, 33 are aligned and their respective lugs 30, 32 secured together by a pin 34 through the aligned holes.

In the closed or folded configuration of the plow, shown in FIG. 3, the lugs are spaced apart and are secured in that condition by locking means in the form of a brace 35 that is connected to lugs 30 and 32 by pins 34. Pins 34 are removable for locking and unlocking these hinged connections for the purpose of changing from one plow configuration to the other. For illustration, FIG. 3 shows one brace 35 appropriately connected, and the other in a disconnected or rest position. When in the open configuration depicted in FIG. 2, the brace means 35 is preferably stored by attaching it using the hitch pins.

Pivotal movement of the end blades relative to the central blade between open and closed configurations is substantially 90° as shown, but it might be greater than 90° if it is desired to form a more compact arrangement for transport. In an open position as depicted in FIGS. 1 and 2, the alignment of the left, center and right blades is preferably controlled by hinge plates and bosses previously described, the assembly of the blades being accomplished via fixturing to control the exact placement of such elements.

Figure 5:
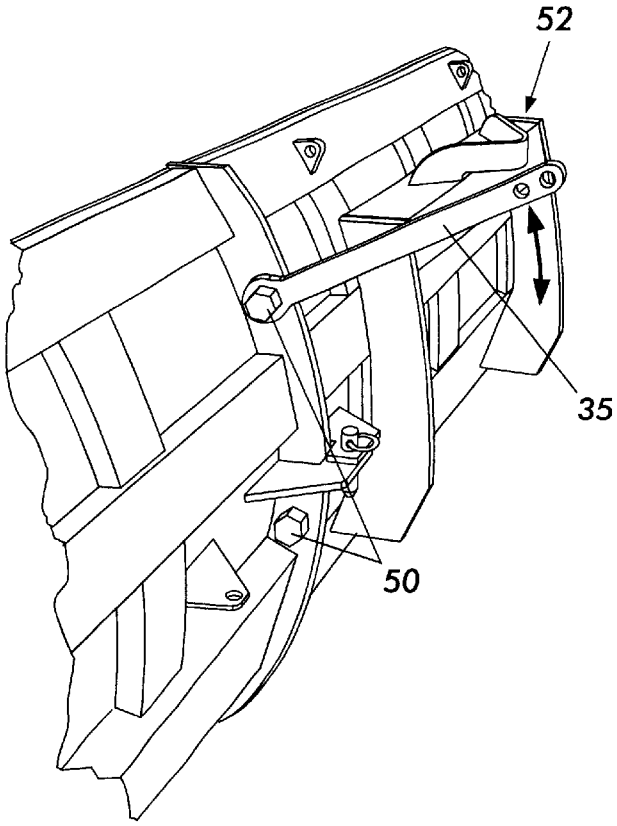
FIG. 5 is a perspective illustration of the pusher in accordance with an alternative embodiment.

In an alternative embodiment depicted in FIGS. 2, 4 and 5, the alignment of the end blades 10L, 10R relative to the center blade 10C may be adjusted using a plurality of adjustment bolts 50 that a threaded through the hinge plate of the end blade and bear against the outer surface of the hinge plate 26 on the central blade. In this fashion, the adjustment bolts may be advanced or removed to control the angle between the respective hinge plates, thereby controlling the linear alignment of the center and end blades. As further depicted in FIG. 5, the brace 35 may be manufactured with at least one hexagonal hole in an end thereof in order to enable the brace to be used as a "wrench" for turning the adjustment bolts 50.

Referring next to FIGS. 6 through 9, there are depicted various alternative means for simultaneously moving the end blades between opened and folded positions relative to the central blade. In the embodiments depicted the means for simultaneously moving the end blades 10L, 10R between opened and folded positions includes a pair of fluid-responsive cylinders 60, such as hydraulic cylinders. Cylinders 60 (60L and 60 R in FIGS. 8 and 9) are preferably welded hydraulic cylinders such as Model SAE-9124 by Prince Hydraulics, where the stroke is 24 inches and the bore is approximately 2.5 inches in diameter with a 1-inch rod. The cylinder and rod ends each have clevis-type connections at the end to allow for the pivotal connection to the blades. It will be further appreciated that more or fewer cylinders may be employed to accomplish the relative movement of both end blades (10L, 10R) relative to the central blade 10C.

Also depicted in the embodiment of FIG. 5 is a quick-coupler receptacle 52, suitable for connecting the pusher to an American Coupler Systems Series 1500 TLB Quick Coupler or Pro Series 2000® coupler (both AGS Industries, Inc.) mounted on the front of a loader or similar vehicle (not shown). Although the ACS system is depicted, it will be further appreciated that aspects of the present invention may be implemented on pushers that incorporate various quick-coupling attachment means, including hydraulic and manually-operated quick couplers for wheel loaders and tractor loader backhoes. Equivalent quick-coupling designs include those manufactured by JRB Company, Inc., Earth-moving Solutions (Australia), Industrial Machinery Attachment Company (IMAC InterCoupler, Canada), Volvo, Rockland, Case and John Deere.

Figure 6:
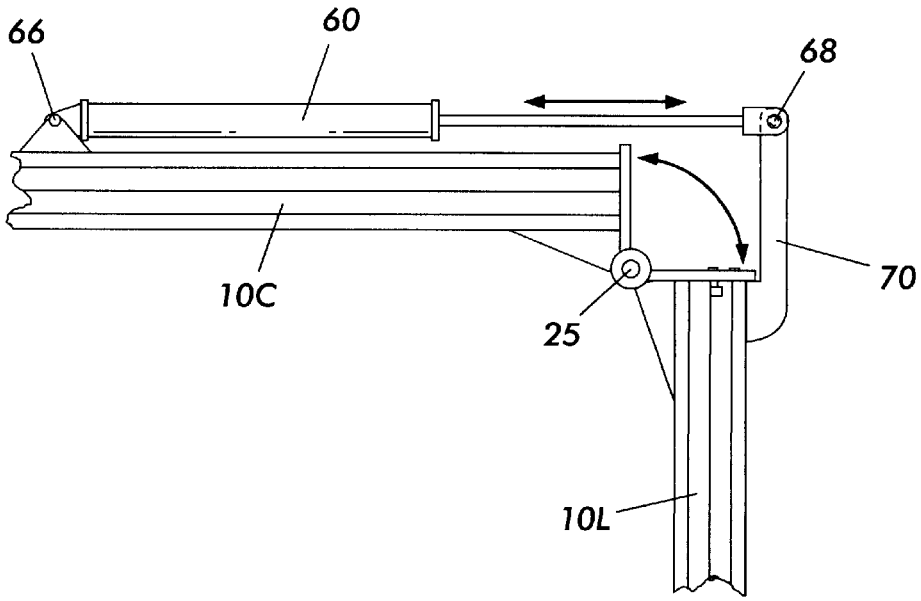
FIGS. 6–7 are illustrative examples of alternative embodiments for an automated system for simultaneously opening and closing the end blades of the invention depicted in FIG. 1.
Figure 7:
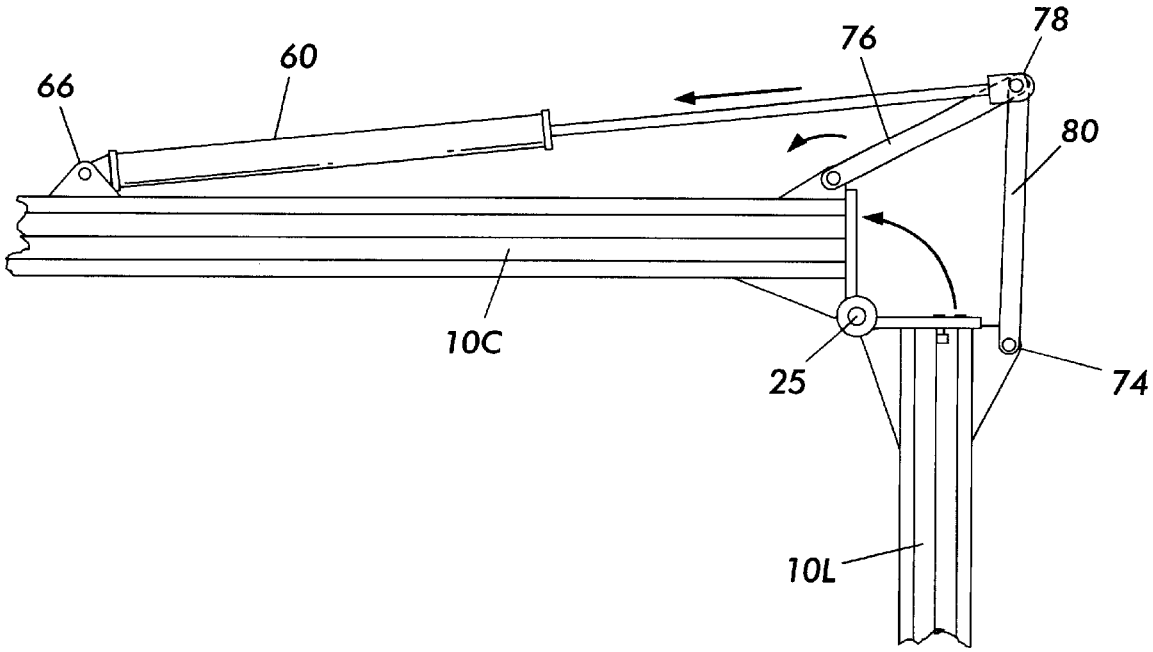

As illustrated in FIGS. 6 and 7, the cylinder is preferably pivotally attached to the central blade 10C by a clevis or similar pin 66 attached to the cylinder and to the respective end blade 10L, 10R by a clevis or similar attachment 68 via the rod end. Activation of the hydraulic cylinder cause the internal piston to advance the rod from the cylinder, thereby pushing the pivot point 68 away from point 66, so as to swing the end blades about the hinges 25.

With specific reference to FIG. 6, the hydraulic cylinder rod is directly attached to a lever plate 70 attached to the end blade (e.g., 10L). Hence, the position of the end blade is driven by the fluid-responsive cylinder 60 under the control of a hydraulic system as represented by the arrows and as will be described in further detail below.

In the alternative arrangement depicted in FIG. 7, the means for moving the end blades includes a lever plate or pivot gusset 74 attached to the end blade and a first control bar 76, pivotally attached at one end to the end of the central blade 10C and at the other end to the extendible end of the fluid-controlled cylinder at link-joint 78. A second bar 80 is pivotally attached at one end to the extendible end of the fluid controlled cylinder and the first control bar (at joint 78), and at the other end to the lever plate 74 to form what is referred to as a 3-bar of "Pro-Link" type linkage. In operation, extension of the fluid-controlled cylinder results in folding of the end blade about the hinge 25, and retraction of the fluid-controlled cylinder results in opening of the end blade as depicted by the arrows.

Figure 8:
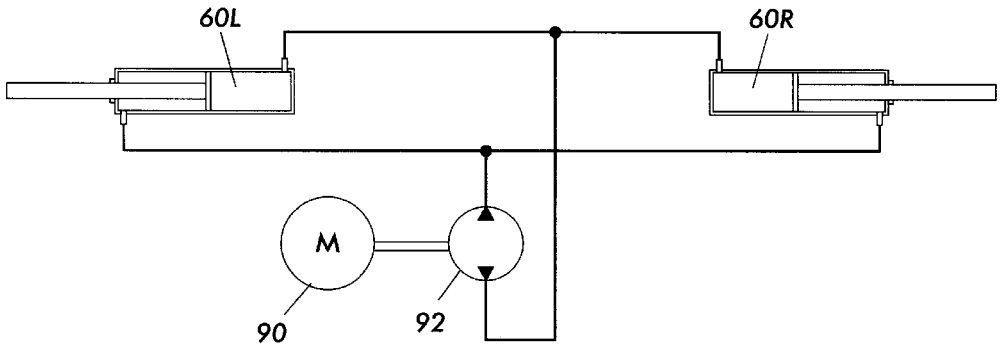

Referring next to FIG. 8, there is depicted a first hydraulic system for controlling the operation of the hydraulic cylinders 60. As depicted in the figure, the cylinders are double-acting cylinders, meaning that the piston therein may be driven in both directions. Driving the cylinders is a motor 90 (e.g., a 12-volt starter motor) operatively connected to a bi-directional hydraulic pump 92, where the direction of hydraulic fluid flow determines the direction of operation of the cylinders 60L, 60R. It will be appreciated that the direction of fluid flow may be controlled by a reversible pump/motor or via a multiported-solenoid controlled valve in response to an electrical signal controlled by a switch associated with the vehicle. In the embodiment depicted, the pressure generated by the motor/pump combination is sized in accordance with the rated pressure of the cylinders, and the folding of the end blades to a folded position results in a deadening of the cylinder movement without any adverse impact to the system (slight increase in cylinder pressure).

Figure 9:
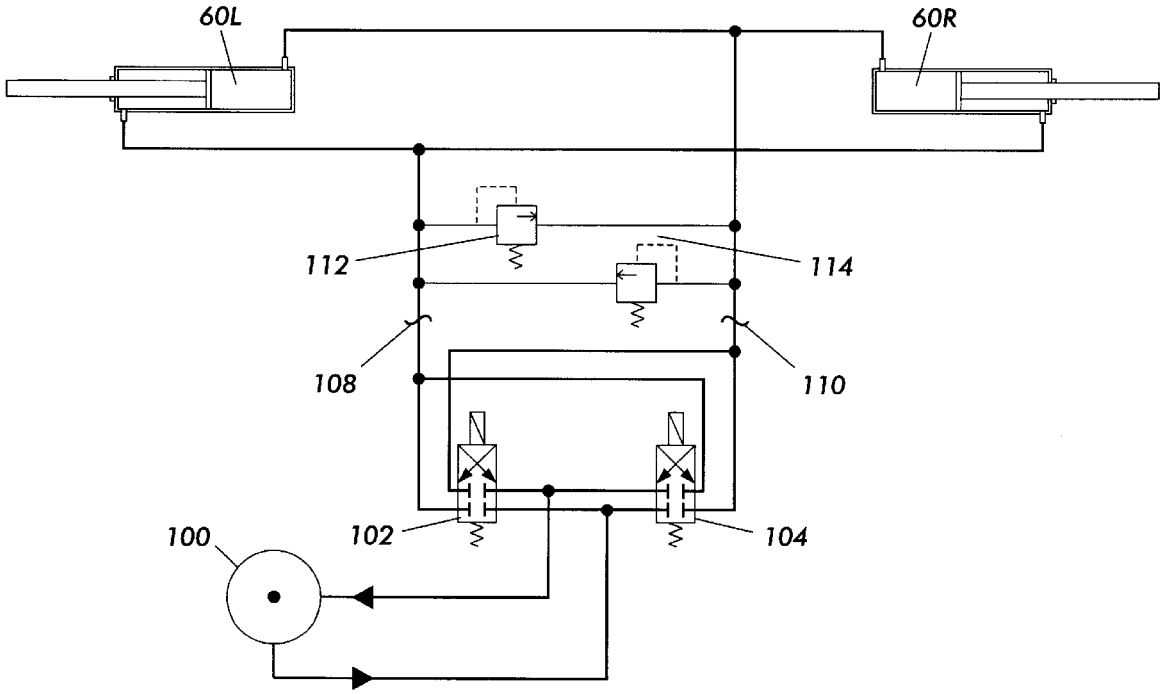
FIG. 9 is an illustrative example of an alternative embodiment for a hydraulic system operating in accordance with the hydraulic cylinders of FIGS. 6 and 7.

Considering the alternative hydraulic system of FIG. 9, such a system is intended for use on loaders or other vehicles and equipment having what is commonly referred to as a "3$^{rd}$ valve" hydraulic port—depicted in the figure as a hydraulic source 100. Such a system typically includes manually or electrically operated valves (e.g., solenoid valves) 102 and 104 that control the flow direction of hydraulic fluid to the cylinders. The 3$^{rd}$ valve hydraulic system of a loader is preferably interconnected with the pusher hydraulic system via connectors 108 and 110. Included in the pusher hydraulic system are a pair of pressure regulating valves 112 and 114 (e.g., Model RPGC-LAN cartridge) suitable for regulating pressures of up to 3000 psi as found in Many 3$^{rd}$ valve systems. Because the pressure typically found in a 3$^{rd}$ valve hydraulic system is significantly higher than the recommended operating pressure for cylinders used to control the position of the end blades, the pressure regulators are employed to relieve any over-pressure when the stroke of the cylinder is at or near the end of travel (controlled via the hinge plates meeting or via mechanical stops about hinge 25).

Figure 10:
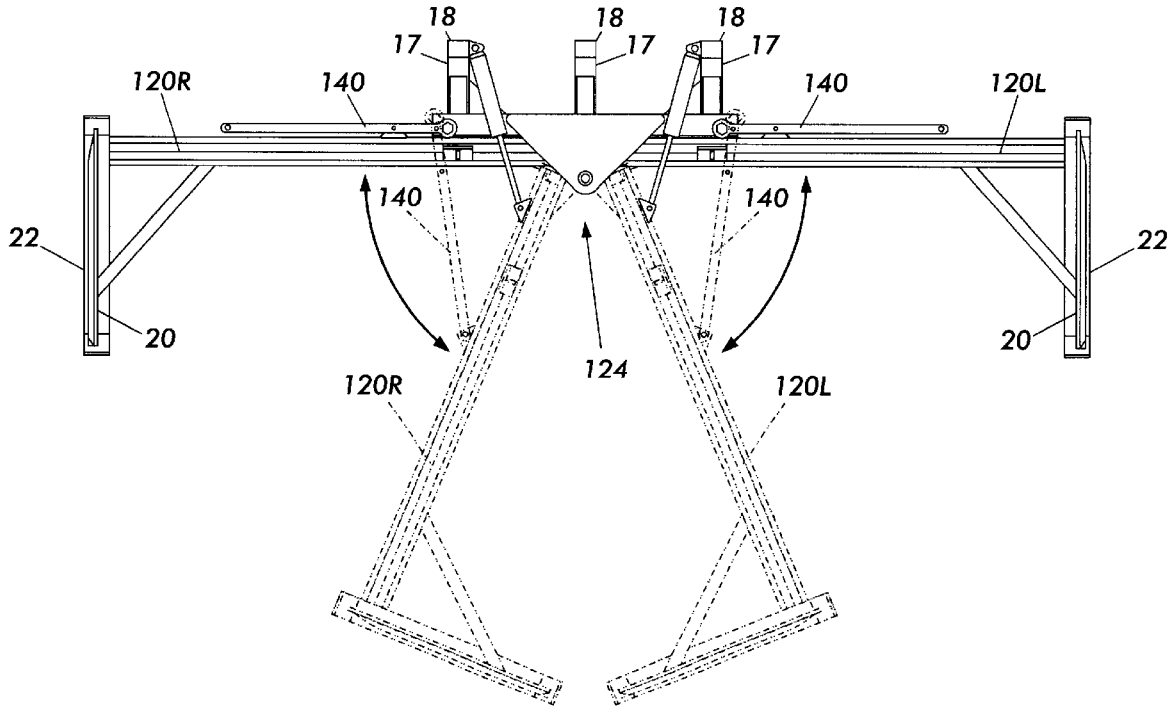
FIGS. 10 and 11 depict an alternative, bi-fold blade arrangement in accordance with an alternative embodiment of the present invention.
Figure 11:
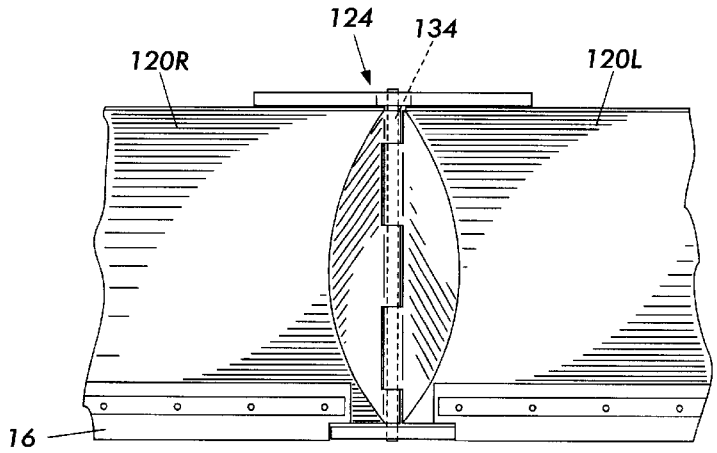

In yet a further alternative embodiment, a transportable pusher is provided in accordance with the present invention using a pair of blades that fold forward about a single hinge point. Referring to FIGS. 10 and 11, there is depicted an upstanding left blade 120L and an upstanding right blade 120R. In the bi-fold arrangement, a mounting bracket 124 is employed for pivotally interconnecting the left and right blades. The mounting bracket preferably includes an upper row of posts 17 projecting horizontally rearward from said central blade and a lower row of posts 18 projecting horizontally rearward from said central blade so as to form a slot therebetween for removable insertion of a bucket to lift and push said apparatus as described above.

Left and right blades 120L and 120R are pivotally connected to the mounting bracket 124 for movement relative thereto between an open position wherein the left and right blades are substantially linearly aligned, and a folded position (shown in dashed lines) wherein the left and right blades are brought forward of and nearly normal to the mounting bracket. As illustrated in FIG. 11, mounting bracket 124 further includes a large central boss 130 as well as upper and lower bosses 132 and 134 that are aligned with bosses on each end of the blades so as to receive one or more hinge pins therethrough to pivotally connect the blades to the mounting bracket. Also included in the bi-fold embodiment is a reversible rubber edge 16 removably fastened to each of said left and right blades and extending along and below the bottom edge thereof. The left and right blades further include a vertical side wall 20 extending forward at a right angle from the outer ends thereof. The side walls 20 each including a wear shoe 22 removably mounted thereon, said wear shoes including a bottom longitudinal runner and front and rear ramp surfaces as described above with respect to FIG. 1.

The bi-fold embodiment further includes locking means in the form of braces 140, wherein the braces lock said end blades alternatively in said open positions and in said folded positions (braces shown in dashed form). It will be further appreciated that the locking means may be accomplished by chains use to retain the blades in an open position or to connect the ends of the blades when in the folded position.

In recapitulation, the present invention is apparatus for use on large areas such as parking lots and airport runways to remove snow and other debris therefrom. The apparatus includes at least two blades pivotally connected to one another, and a series of pairs of posts extending from the rear thereof to facilitate operational attachment to a loader or similar construction equipment. The present invention includes improvements to allow for the segmenting and automatic folding of a pusher, and to aspects resulting in reduced cost of manufacturing.

It is, therefore, apparent that there has been provided, in accordance with the present invention, an improved pusher. While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A foldable apparatus for pushing material, including:

an upstanding central blade;

means for attaching the pushing apparatus to a vehicle used for moving the pushing apparatus;

left and right end blades;

left and right hinges for pivotally connecting the respective left and right end blades with the corresponding ends of said central blade for movement relative to said central blade between open positions substantially in line with said central blade, and folded positions forward of and substantially normal to said central blade;

a rubber edge removably fastened to each of said central, left end and right end blades and extending along and below the bottom edge thereof;

a vertical side wall extending forward at a right angle from the outer end of each of said end blades, said side walls each including a removable longitudinal runner along the bottom of said wall, said runners having inclined front and rear ramp surfaces for sliding contact on a ground surface, said runners effective to provide clearance space under the bottom edges of said blades; and locking means to lock said end blades in said open positions and in said folded positions.

2. The apparatus of claim 1, wherein said attaching means includes:

upper and lower rows of posts extending rearward from said central blade in a generally horizontal fashion, said upper and lower rows of posts defining between them an open slot for removable insertion therein of a bucket to lift and push said pusher; and tubular supports, extending from an upper surface of at least two of said upper posts, to the rear of said central blade.

3. The apparatus of claim 2, wherein said upper posts are shorter than said lower posts, and where the bucket may be placed upon the upper surface of the lower post and driven toward the central blade in order to insert the bucket within the open slot.

4. The apparatus of claim 1, wherein said attaching means includes:

at least one quick-coupling receptacle for the attachment of the central blade to. the vehicle.

5. The apparatus of claim 1, wherein said left and right hinges include:

an end blade hinge plate having an upper boss and a lower boss extending therefrom;

a central blade hinge plate having a pair of upper and lower boss sets extending therefrom, wherein said pairs of upper and lower boss sets are located so as to be in relative alignment with the upper and lower bosses of the end blade when assembled;

hinge pins for each of said upper and lower boss sets; and where said locking means is removable.

6. The apparatus of claim 5, further including means for adjusting a spacing between the end blade hinge plate and the central blade hinge plate so as to control the linear alignment of the central and end blades when the pusher apparatus is in an open condition, wherein said locking means includes a bar and where the bar is suitable for the manual alteration of the adjustment means.

7. The pusher apparatus of claim 1, further including means for simultaneously moving the end blades between opened and folded positions relative to the central blade.

8. The pusher apparatus of claim 7, wherein said means for simultaneously moving the end blades between opened and folded positions includes a pair of fluid-responsive cylinders, each cylinder being attached between the central blade and a respective end blade so as to swing the end blades about the hinges.

9. The pusher apparatus of claim 8, further including a pump operatively associated with the pusher apparatus, wherein the fluid-responsive cylinders are supplied with fluid from the pump in response to an electrical signal controlled by a switch associated with the vehicle.

10. The pusher apparatus of claim 8, further including a hydraulic loop operatively associated with the vehicle, wherein the fluid-responsive cylinders are supplied with fluid from the hydraulic loop in response to the operation of a hydraulic valve associated with the vehicle.

11. The pusher apparatus of claim 10, wherein the fluid-responsive cylinders are double-acting hydraulic cylinders, and where the means for automatically controlling the end blades further includes a hydraulic control system for limiting the pressure of hydraulic fluid applied to said cylinders.

12. The pusher apparatus of claim 8, further including:

a lever plate attached to the end blade;

a first control bar pivotally attached at one end to the end of the central blade and at the other end to the extendible end of the fluid-controlled cylinder;

a second bar pivotally attached at one end to the extendible end of the fluid-controlled cylinder and the first control bar, and at the other end to the lever plate, wherein extension of the fluid-controlled cylinder results in folding of the end blade about the hinge and where retraction of the fluid-controlled cylinder results in opening of the end blade.

13. The pusher apparatus of claim 8, further including a lever plate attached to the end blade and driven by the fluid-responsive cylinder.

14. The pusher apparatus of claim 1, further including a gusset associated with the hinged end of the central, left end and right end blades, said gussets being placed at an angle from the end of the hinge plate and the blade associated therewith.

* * * * *

UNITED STATES PATENT AND TRADEMARK OFFICE

CERTIFICATE OF CORRECTION

PATENT NO. : 6,425,196 B1
APPLICATION NO. : 09/634141
DATED : July 30, 2002
INVENTOR(S) : Michael P. Weagley, Michael J. Guggino and John W. Singer It is certified that error appears in the above-identified patent and that said Letters Patent is hereby corrected as shown below:

Column 5, line 34, the word "show" should read --snow--.

Signed and Sealed this

Seventh Day of November, 2006

JON W. DUDAS
*Director of the United States Patent and Trademark Office*